US009869213B2

(12) United States Patent
Son et al.

(10) Patent No.: US 9,869,213 B2
(45) **Date of Patent: *Jan. 16, 2018**

(54) CONTINUOUS VARIABLE VALVE LIFT APPARATUS AND ENGINE PROVIDED WITH THE SAME

(71) Applicant: Hyundai Motor Company, Seoul (KR)

(72) Inventors: You Sang Son, Suwon-si (KR); Kyoung Pyo Ha, Seongnam-si (KR); Back Sik Kim, Osan-si (KR); Kiyoung Kwon, Yongin-si (KR)

(73) Assignee: Hyundai Motor Company, Seoul (KR)

( * ) Notice: Subject to any disclaimer, the term of this patent is extended or adjusted under 35 U.S.C. 154(b) by 104 days.

This patent is subject to a terminal disclaimer.

(21) Appl. No.: 14/955,211

(22) Filed: Dec. 1, 2015

(65) Prior Publication Data

US 2017/0081987 A1 Mar. 23, 2017

(30) Foreign Application Priority Data

Sep. 21, 2015 (KR) ..... 10-2015-0133341

(51) Int. Cl.

| | |
|---|---|
| ***F01L 1/34*** | (2006.01) |
| ***F01L 1/26*** | (2006.01) |
| ***F01L 1/047*** | (2006.01) |
| ***F01L 1/18*** | (2006.01) |
| ***F01L 1/24*** | (2006.01) |
| ***F01L 1/46*** | (2006.01) |
| ***F01L 13/00*** | (2006.01) |

(52) U.S. Cl.

CPC ..... *F01L 1/267* (2013.01); *F01L 1/047* (2013.01); *F01L 1/18* (2013.01); *F01L 1/185* (2013.01); *F01L 1/2405* (2013.01); *F01L 1/462* (2013.01); *F01L 13/0063* (2013.01); *F01L 2013/0068* (2013.01); *F01L 2105/00* (2013.01); *F01L 2820/03* (2013.01)

(58) Field of Classification Search

CPC ... F01L 1/267; F01L 1/047; F01L 1/18; F01L 1/185; F01L 2820/03

USPC ..... 123/90.16, 90.39, 90.44, 90.27, 90.31, 123/90.6

See application file for complete search history.

(56) References Cited

U.S. PATENT DOCUMENTS 9,574,467 B2 * 2/2017 Ha ..... F01L 13/0015 123/90.16

FOREIGN PATENT DOCUMENTS

| | | |
|---|---|---|
| JP | 2015-117692 A | 6/2015 |
| KR | 10-2010-0047673 A | 5/2010 |

* cited by examiner

*Primary Examiner* — Ching Chang
(74) *Attorney, Agent, or Firm* — Morgan, Lewis & Bockius LLP

(57) ABSTRACT

A continuously variable valve lift apparatus may include a camshaft, a cam portion on which a cam is formed and into which the camshaft is inserted, a slider housing into which the cam portion is rotatably inserted and disposed to be rotatable around a pivot shaft, a control portion configured to selectively rotate the slider housing around the pivot shaft, a rotation deliverer configured to transmit rotation of the camshaft to the cam portion, an output portion rotatable around the pivot shaft and on which a valve shoe is formed, and a valve device configured to be driven by the valve shoe.

20 Claims, 9 Drawing Sheets

CONTINUOUS VARIABLE VALVE LIFT APPARATUS AND ENGINE PROVIDED WITH THE SAME

CROSS-REFERENCE TO RELATED APPLICATION

The present application claims priority to Korean Patent Application No. 10-2015-0133341 filed Sep. 21, 2015, the entire contents of which is incorporated herein for all purposes by this reference.

BACKGROUND OF THE INVENTION

Field of the Invention

The present invention relates to a continuous variable valve lift apparatus and an engine provided with the same. More particularly, the present invention relates to a continuous variable valve lift apparatus an engine provided with the same which may vary valve lift according to operation conditions of an engine with a simple construction.

Description of Related Art

An internal combustion engine generates power by burning fuel in a combustion chamber in an air media drawn into the chamber. Intake valves are operated by a camshaft in order to intake the air, and the air is drawn into the combustion chamber while the intake valves are open. In addition, exhaust valves are operated by the camshaft, and a combustion gas is exhausted from the combustion chamber while the exhaust valves are open.

Optimal operation of the intake valves and the exhaust valves depends on a rotation speed of the engine. That is, an optimal lift or optimal opening/closing timing of the valves depends on the rotation speed of the engine. In order to achieve such optimal valve operation depending on the rotation speed of the engine, various researches, such as designing of a plurality of cams and a continuous variable valve lift (CVVL) that can change valve lift according to engine speed, have been undertaken.

Also, in order to achieve such an optimal valve operation depending on the rotation speed of the engine, research has been undertaken on a continuously variable valve timing (CVVT) apparatus that enables different valve timing operations depending on the engine speed. The general CVVT may change valve timing with a fixed valve opening duration.

However, the general CVVL and CVVT are complicated in construction and are expensive in manufacturing cost.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a continuous variable valve lift apparatus and an engine provided with the same which may vary valve lift according to operation conditions of an engine, with a simple construction.

According to various aspects of the present invention, a continuously variable valve lift apparatus may include a camshaft, a cam portion on which a cam is formed and into which the camshaft is inserted, a slider housing into which the cam portion is rotatably inserted and disposed to be rotatable around a pivot shaft, a control portion configured to selectively rotate the slider housing around the pivot shaft, a rotation deliverer configured to transmit rotation of the camshaft to the cam portion, an output portion rotatable around the pivot shaft and on which a valve shoe is formed, and a valve device configured to be driven by the valve shoe.

The rotation deliverer may include an inner plate connected to the camshaft and from which a control pin protrudes, and an outer plate on which a control slot where the control pin movable therein is formed, and configured to transmit rotation of the inner plate to the cam portion.

The rotation deliverer may further include a rotation housing formed to the cam portion, and the outer plate may be connected to the rotation housing.

A stopper may protrude from the inner plate, and a stopper slot may be formed to the outer plate for limiting movement of the stopper.

The continuously variable valve lift apparatus may further include a bearing disposed between the cam portion and the slider housing.

The control portion may include an eccentric shaft rotatably connected to the slider housing, and a control motor configured to selectively rotate the eccentric shaft for changing a position of the slider housing.

A pivot shaft hole into which the pivot shaft is inserted and an eccentric shaft hole into which the eccentric shaft is inserted may be formed to the slider housing.

The output portion may include an output roller contacting the cam.

The valve device may include a swing arm roller contacting the valve shoe, and a valve.

The rotation deliverer may be formed to both sides of the slider housing, the cam may be disposed between the slider housing and each rotation deliverer, the output portion may include two output rollers contacting each cam and two valve shoes, and the valve device may include two swing arm rollers contacting each valve shoe and valves.

The rotation deliverer may include an inner plate connected to the camshaft and from which a control pin protrudes, a rotation housing formed on the cam portion, and an outer plate on which a control slot where the control pin movable therein is formed, and configured to transmit rotation of the inner plate to the cam portion.

According to various aspects of the present invention, an engine may include a camshaft, a cam portion on which a cam is formed and into which the camshaft is inserted, a slider housing into which the cam portion is rotatably inserted and disposed to be rotatable around a pivot shaft mounted to a cylinder head, a control portion configured to selectively rotate the slider housing around the pivot shaft, a rotation deliverer configured to transmit rotation of the camshaft to the cam portion, an output portion rotatable around the pivot shaft and on which a valve shoe is formed, and a valve device configured to be driven by the valve shoe.

The engine may further include a bearing disposed between the cam portion and the slider housing.

As described above, a continuous variable valve lift apparatus according to various embodiments of the present invention may vary valve lift according to operation conditions of an engine, with a simple construction.

The continuous variable valve lift apparatus according to various embodiments of the present invention may reduce duration in minimum valve lift comparing to general continuous variable valve lift apparatuses.

The continuous variable valve lift apparatus according to various embodiments of the present invention may advance closing timing of an intake valve so that may reduce pumping loss and enhance fuel economy.

The continuous variable valve lift apparatus according to various embodiments of the present invention may be reduced in size and thus the entire height of a valve train may be reduced.

Since the continuous variable valve lift apparatus may be applied to an existing engine without excessive modification, thus productivity may be enhance and production cost may be reduced.

It is understood that the term "vehicle" or "vehicular" or other similar terms as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g., fuel derived from resources other than petroleum). As referred to herein, a hybrid vehicle is a vehicle that has two or more sources of power, for example, both gasoline-powered and electric-powered vehicles.

The methods and apparatuses of the present invention have other features and advantages which will be apparent from or are set forth in more detail in the accompanying drawings, which are incorporated herein, and the following Detailed Description, which together serve to explain certain principles of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention (s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Figure 1:
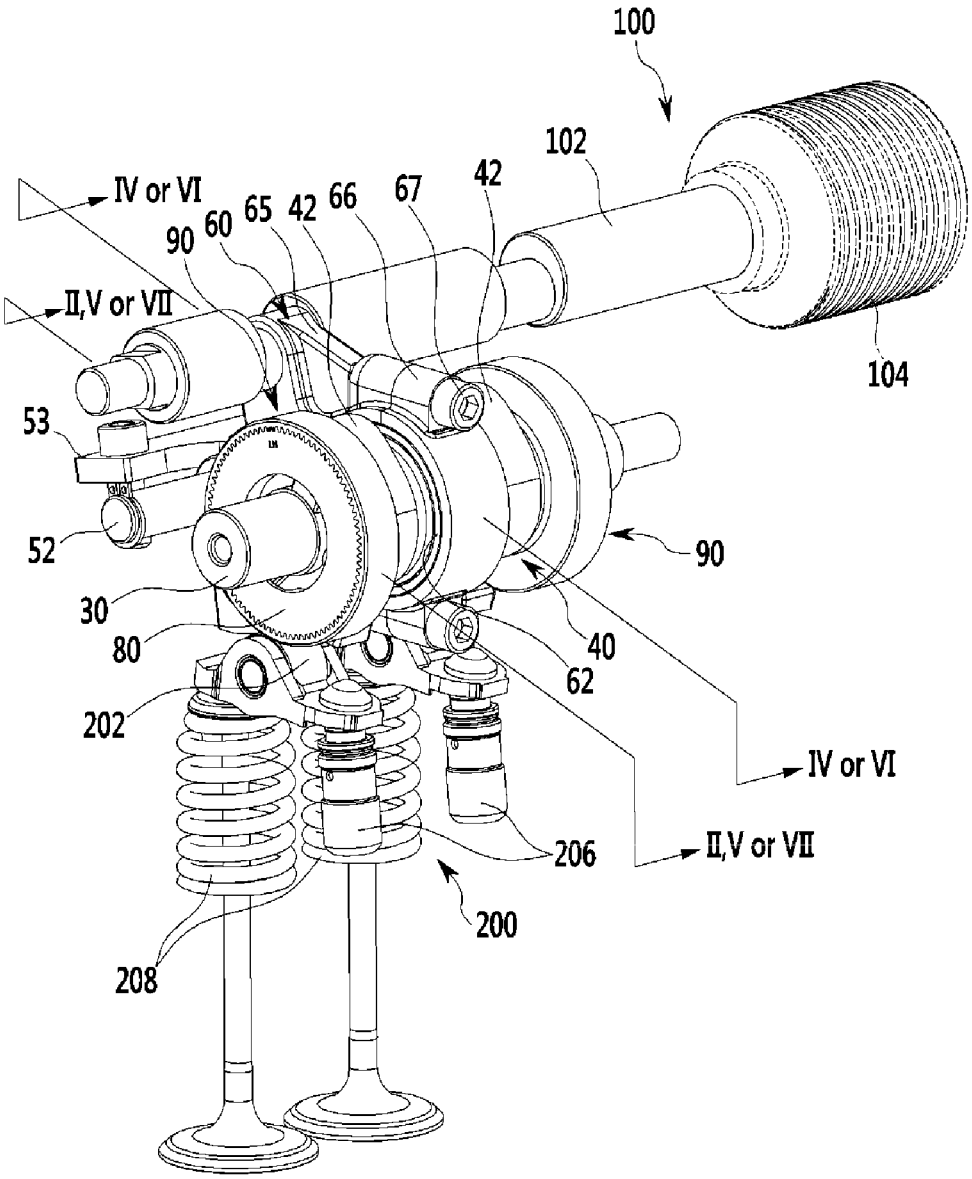
FIG. 1 is a perspective view of an exemplary continuous variable valve lift apparatus according to the present invention.
Figure 2:
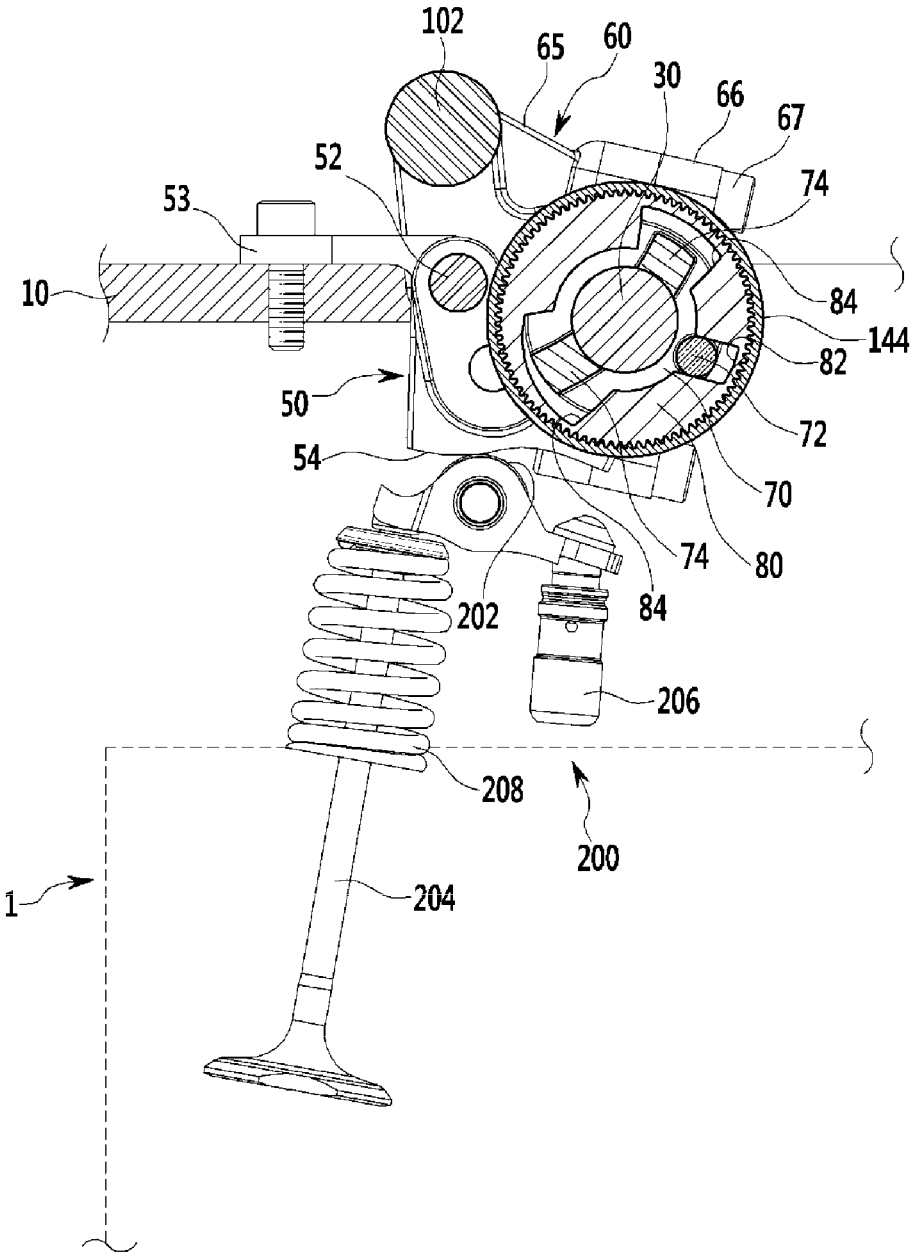
FIG. 2 is a cross-sectional view along line II-II of FIG. 1.
Figure 3:
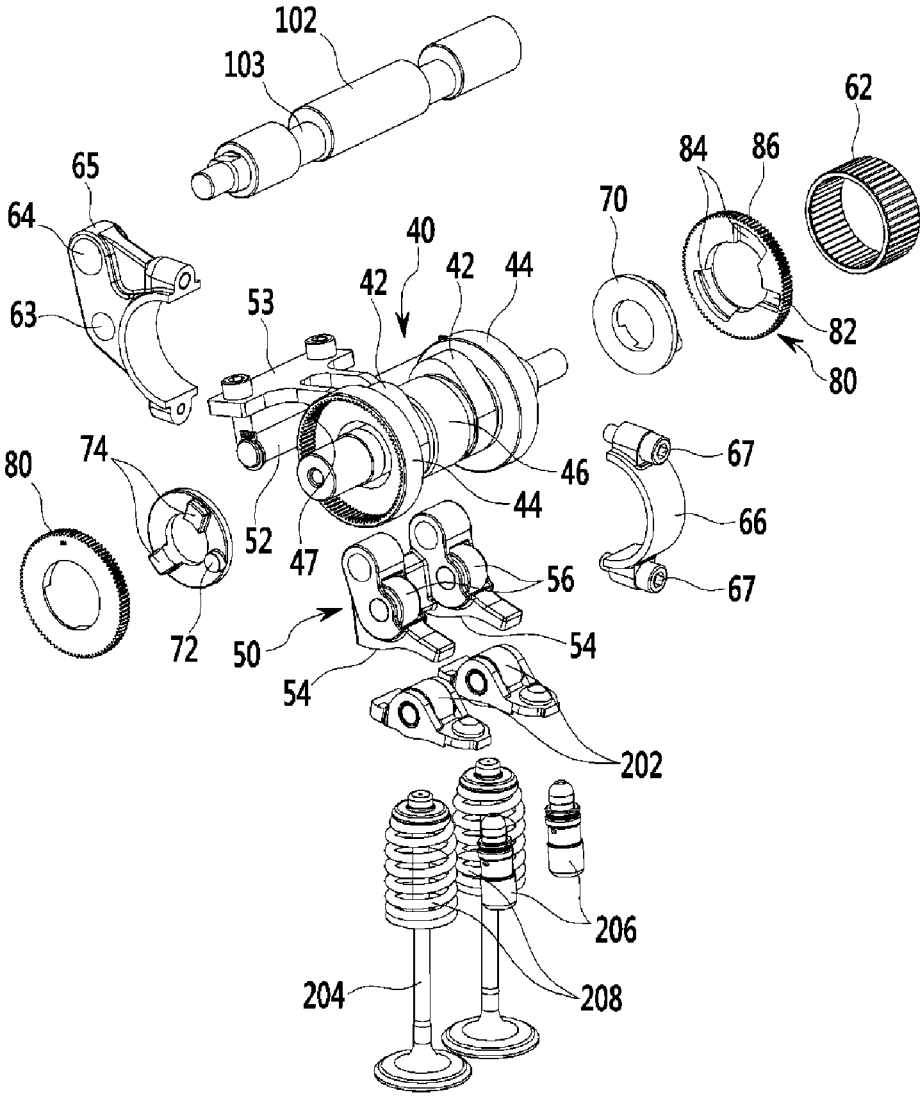
FIG. 3 is an exploded perspective view of the exemplary continuous variable valve lift apparatus according to the present invention.

FIG. 1 is a perspective view of a continuous variable valve lift apparatus according to various embodiments of the present invention, FIG. 2 is a cross-sectional view along line II-II of FIG. 1 and FIG. 3 is an exploded perspective view of a continuous variable valve lift apparatus according to various embodiments of the present invention.

Referring to FIG. 1 to FIG. 3, an engine 1 according to various embodiments of the present invention includes a cylinder head 10 and a continuous variable valve lift apparatus mounted to the cylinder head 10.

The continuously variable valve lift apparatus according to various embodiments of the present invention includes a camshaft 30, a cam portion 40 of which a cam 42 is formed thereto and the camshaft 30 is inserted therein, a slider housing 60 of which the cam portion 40 is rotatably inserted therein and disposed rotatable around a pivot shaft 52, a control portion 100 configured to selectively rotate the slider housing 60 around the pivot shaft 52, a rotation deliverer 90 transmitting rotation of the camshaft 30 to the cam portion 40, an output portion 50 rotatable around the pivot shaft 52 and of which a valve shoe 54 is formed thereto and a valve device 200 configured to be driven by the valve shoe 54.

The pivot shaft 52 is mounted to the cylinder head 10 through a mounting bracket 53, and in the detailed description and claims, the cylinder head 10 is interpreted as including a cam carrier.

The rotation deliverer 90 includes an inner plate 70 connected to the camshaft 30 and of which a control pin 72 is protruded therefrom and an outer plate 80 of which a control slot 82 where the control pin 72 movable therein is formed thereto and transmitting rotation of the inner plate 70 to the cam portion 40.

The rotation deliverer 90 further includes a rotation housing 44 formed to the cam portion 40, and the outer plate 80 is connected to the rotation housing 44.

As shown in drawings, an outer plate gear 86 is formed to the outer plate 80, a housing gear 47 is formed to the rotation deliverer 90 and the outer plate gear 86 and the housing gear 47 are engaged each other.

A stopper 74 is protruded from the inner plate 70 and a stopper slot 84 is formed to the outer plate 84 for limiting movement of the stopper 74.

A driving surface 46 may be formed to the cam portion 40, the slider housing 60 is formed by connecting a first member 65 and a second member 66 through bolts 67, and the driving surface 46 is rotatable within the slider housing 60.

A bearing 62 is inserted between the driving surface 46 and the slider housing 60. Thus, rotation of the cam portion 40 may be easily performed. In the drawings, the bearing 62 is depicted as a needle bearing, however it is not limited thereto. On the contrary, various bearings such as a ball bearing, a roller bearing and so on may be applied thereto.

The control portion 100 includes an eccentric shaft 102 rotatably connected to the slider housing 60 and a control motor 104 selectively rotating the eccentric shaft 102 for changing a position of the slider housing 60.

A pivot shaft hole 63 where the pivot shaft 52 is inserted therein and an eccentric shaft hole 64 where the eccentric shaft 102 is inserted therein are formed to the slider housing 60.

An operation rod 103 is eccentrically formed to the eccentric shaft 102 and inserted into the eccentric shaft hole 64. And according to rotation of the eccentric shaft 102, the slider housing 60 rotates around the pivot shaft 52.

The output portion 50 includes an output roller 56 contacting to the cam 42.

The valve device 200 may be a swing arm including a swing arm roller 202 contacting to the valve shoe 54, a valve 204 and a valve spring 208 and a hydraulic lash adjuster 206 may be provided for adjusting clearance of the valve 204.

As shown in the drawings, the rotation deliverer 90 may be formed to both sides of the slider housing 60, the cam 42 may be disposed between the slider housing 60 and each rotation deliverer 90, the output portion 50 may include two output rollers 56 contacting to each cam 42 and two valve shoes 54 and the valve device 200 may include two swing arm rollers 202 contacting to each valve shoe 54 and valves 204.

That is, in various embodiments of the present invention, two rotation deliverers 90 may support the cam portion 40, one slider housing 60 may be disposed and two cams 42 may open and close two valves 202. Thus numbers of the elements of the continuously variable valve lift apparatus may be reduced and the continuously variable valve lift apparatus may be stably operated.

Figure 4:
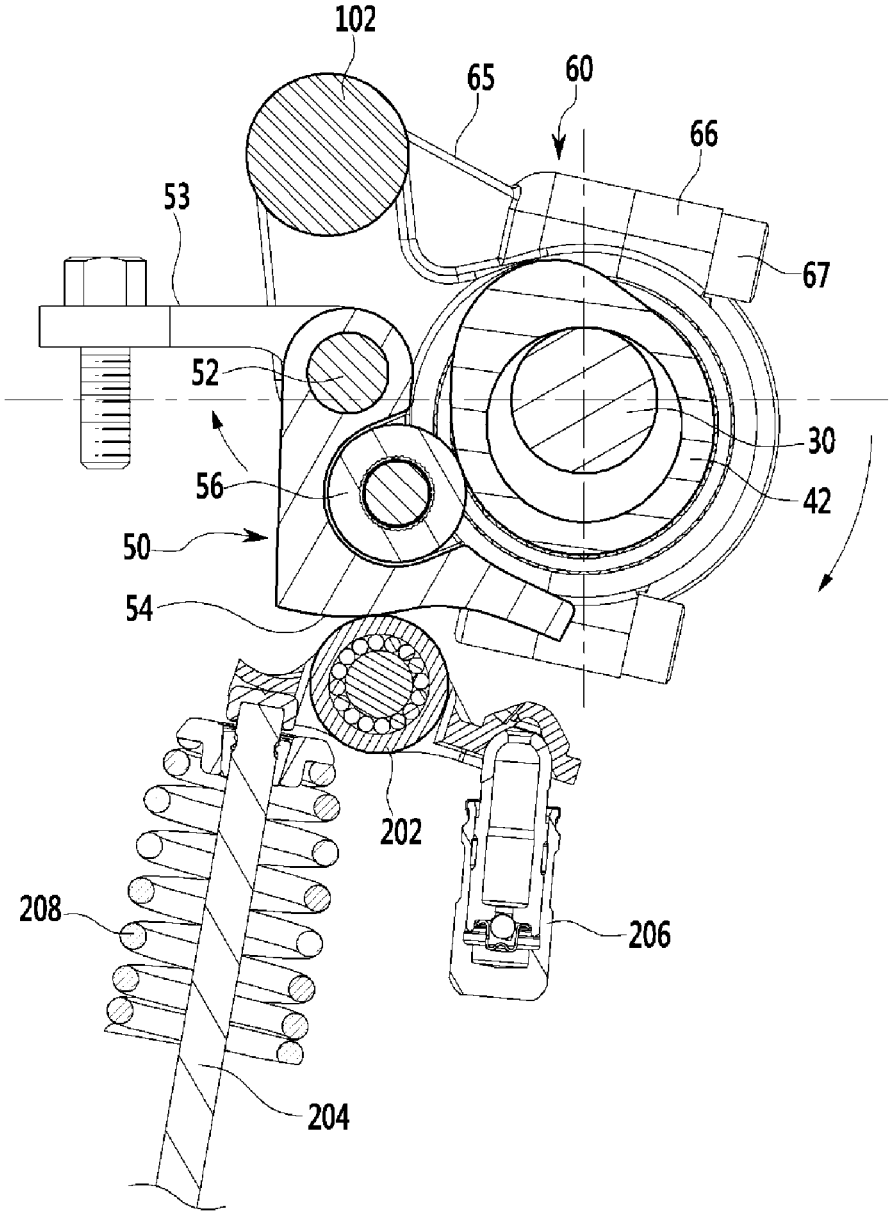
FIG. 4 is a cross-sectional view along line IV-IV of FIG. 1 describing the exemplary continuously variable valve lift apparatus according to the present invention operated in high lift mode.
Figure 5:
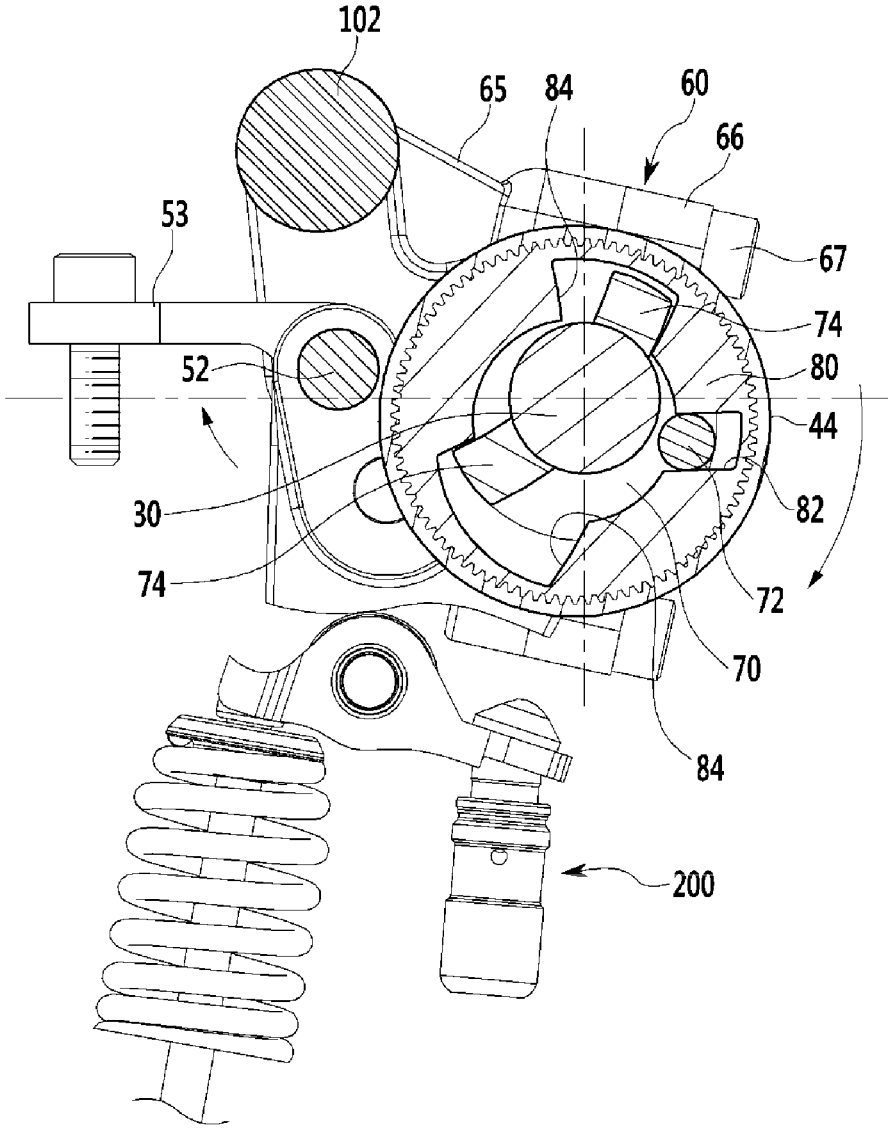
FIG. 5 is a cross-sectional view along line V-V of FIG. 1 describing the exemplary continuously variable valve lift apparatus according to the present invention operated in high lift mode.

FIG. 4 is a cross-sectional view along line IV-IV of FIG. 1 describing a continuously variable valve lift apparatus according to various embodiments of the present invention operated in high lift mode and FIG. 5 is a cross-sectional view along line V-V of FIG. 1 describing a continuously variable valve lift apparatus according to various embodiments of the present invention operated in high lift mode.

Figure 6:
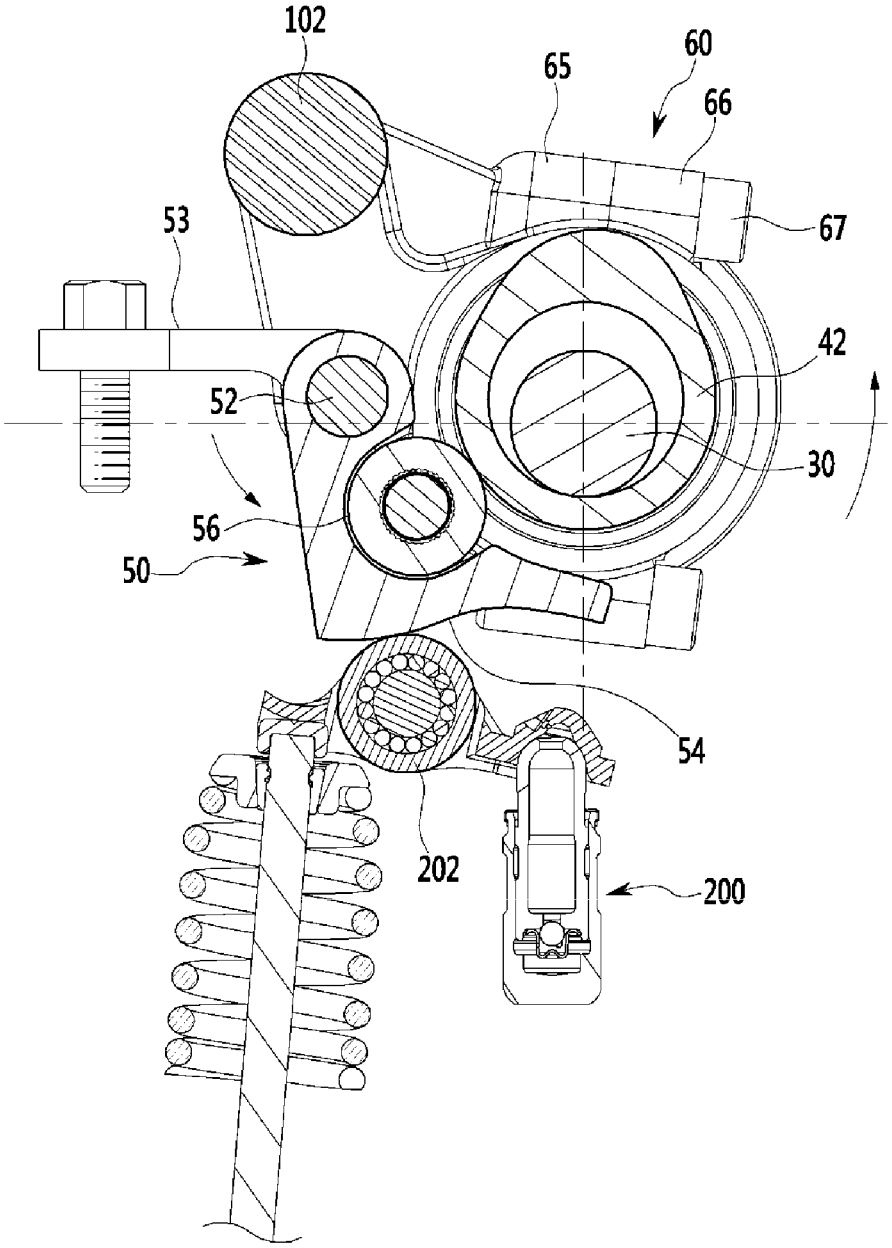
FIG. 6 is a cross-sectional view along line VI-VI of FIG. 1 describing the exemplary continuously variable valve lift apparatus according to the present invention operated in a low lift mode.
Figure 7:
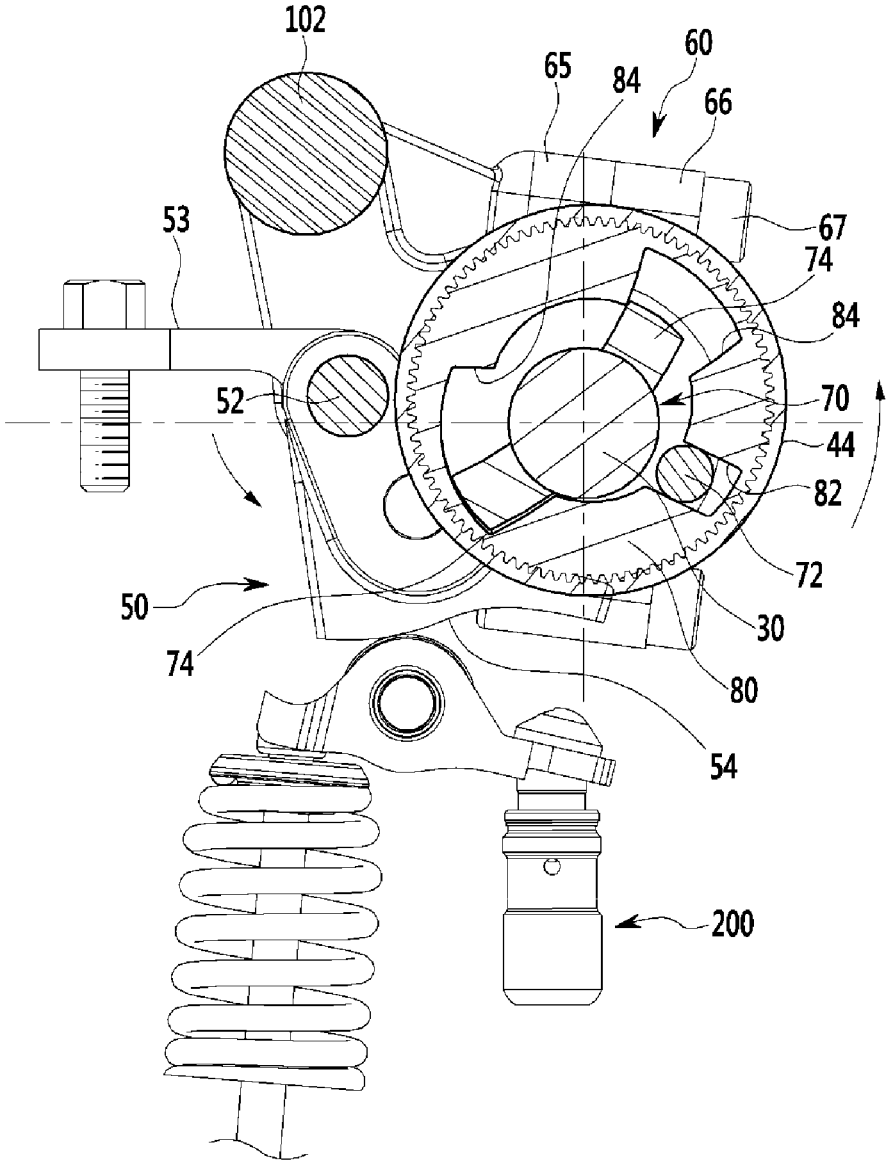
FIG. 7 is a cross-sectional view along line VII-VII of FIG. 1 describing the exemplary continuously variable valve lift apparatus according to the present invention operated in the low lift mode.

FIG. 6 is a cross-sectional view along line VI-VI of FIG. 1 describing a continuously variable valve lift apparatus according to various embodiments of the present invention operated in low lift mode and FIG. 7 is a cross-sectional view along line VII-VII of FIG. 1 describing a continuously variable valve lift apparatus according to various embodiments of the present invention operated in low lift mode.

Hereinafter, referring to FIG. 1 to FIG. 7, operations of the continuously variable valve lift apparatus according to various embodiments of the present invention will be described.

As shown in FIG. 2, when the rotation centers of the camshaft 30 and the cam portion 40 are coincident, the valve 204 realizes a predetermined valve lift profile.

According to engine operation states, the ECU transmits control signals to the motor 104 of the control portion 100 to change the relative position of the slider housing 60.

As shown FIG. 4 and in FIG. 5, for example, in high lift mode requiring high power, the slider housing 60 rotates in a clockwise direction around the pivot shaft 52 according to the operation of the control portion 100.

Then the rotation centers of the camshaft 30 and the cam portion 40 are not coincident, the rotation of the camshaft 30 is transmitted to the inner plate 70, the control pin 72 moves within the control slot 82 and the rotation of the camshaft 30 is transmitted to the cam portion 40.

Since the relative rotation of the cam 42 is changed, the output portion 50 relatively rotates in a clockwise direction around the pivot shaft 52.

Since the output portion 50 relatively rotates in the clockwise direction around the pivot shaft 52, the contacting position of the valve shoe 54 to the swing arm roller 202 are changed to the right direction.

As shown FIG. 6 and in FIG. 7 for example, in low lift mode requiring low power, the slider housing 60 rotates in a counterclockwise direction around the pivot shaft 52 according to the operation of the control portion 100.

Then the rotation centers of the camshaft 30 and the cam portion 40 are not coincident, the rotation of the camshaft 42 is transmitted to the inner plate 70, the control pin 72 moves within the control slot 82 and the rotation of the camshaft 30 is transmitted to the cam portion 40.

Since the relative rotation of the cam 42 is changed, the output portion 50 relatively rotates in a counterclockwise direction around the pivot shaft 52.

Since the output portion 50 relatively rotates in the counterclockwise direction around the pivot shaft 52, the contacting position of the valve shoe 54 to the swing arm roller 202 are changed to the left direction.

In the various embodiments of the present invention, according to the relative position of the slider housing 60 with respect to the camshaft 30, the rotation center of the cam 42 is changed and thus a contacting position of the output roller 56 and the cam 42 is changed. Thus, when the operation mode of the continuously variable valve lift apparatus is changed to the low lift mode, valve closing timing may be advanced.

Also, since the contacting position of the swing arm roller 202 and the valve shoe 54 is changed, the valve lift is adjusted.

Figure 8:
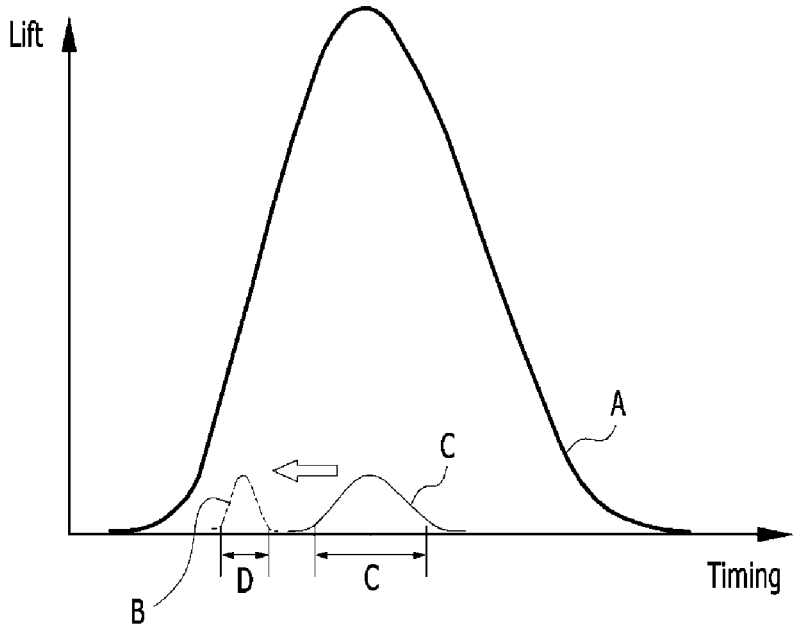
FIG. 8 is a graph of a valve profile of the exemplary continuous variable valve lift apparatus according to the present invention.

FIG. 8 is a graph of a valve profile of a continuous variable valve lift apparatus according to various embodiments of the present invention.

A high lift profile A or a low lift profile B of the valve 204 may be performed according to the relative rotation center of the cam 42 with respect to the camshaft 30, relative positions of the camshaft 30 and the output roller 56 and the contacting position of the valve shoe 54 and the swing arm roller 202.

While only the high lift profile A and the low lift profile are shown in FIG. 8, however it is not limited thereto. The relative position of the slider housing 60 may perform various valve profiles.

As shown in FIG. 8, comparing to a valve duration C of a general continuously variable valve lift apparatus in the low lift mode, a valve duration D of the continuously variable valve lift apparatus according to various embodiments of the present invention may be reduced.

And valve closing time may be advanced comparing to valve closing time of the general continuously variable valve lift apparatus in the low lift mode due to contacting position change of the cam 42 and the output roller 56. Thus, pumping lose may be reduced and enhancement of fuel consumption may be realized.

Figure 9:
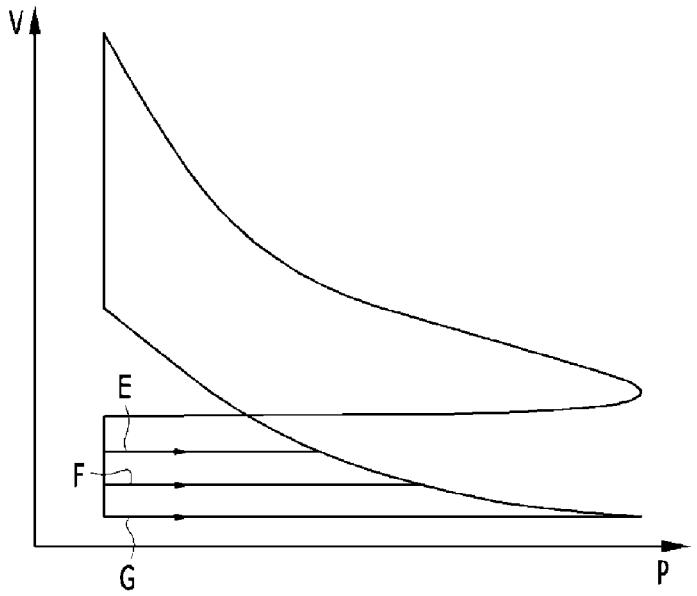
FIG. 9 is a graph of a pressure volume diagram of an engine provided with the exemplary continuous variable valve lift apparatus according to the present invention.

FIG. 9 is a graph of pressure volume diagram of an engine provided with the continuous variable valve lift apparatus.

As shown in FIG. 9, an engine provided with a continuous variable valve lift apparatus may reduce pumping loss F comparing to pumping loss E of an engine without a continuous variable valve lift apparatus.

However, the continuously variable valve lift apparatus may reduce valve duration and advance valve closing time so that may reduce pumping loss G and may enhance fuel economy.

The continuous variable valve lift apparatus according to various embodiments of the present invention may be reduced in size and thus the entire height of a valve train may be reduced.

Since the continuous variable valve lift apparatus may be applied to an existing engine without excessive modification, thus productivity may be enhance and production cost may be reduced.

For convenience in explanation and accurate definition in the appended claims, the terms "upper" or "lower", "inner" or "outer" and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A continuously variable valve lift apparatus comprising:
- a camshaft;
- a cam portion including a cam, wherein the camshaft is inserted into the cam portion;
- a slider housing into which the cam portion is rotatably inserted and disposed to be rotatable around a pivot shaft;
- a control portion selectively rotating the slider housing around the pivot shaft;
- a rotation deliverer transmitting rotation of the camshaft to the cam portion;
- an output portion rotatable around the pivot shaft and on which a valve shoe is formed; and
- a valve device driven by the valve shoe.

2. The continuously variable valve lift apparatus of claim 1, wherein the rotation deliverer comprises:
- an inner plate connected to the camshaft and from which a control pin protrudes; and
- an outer plate on which a control slot where the control pin movable therein is formed, and configured to transmit rotation of the inner plate to the cam portion.

3. The continuously variable valve lift apparatus of claim 2, wherein the rotation deliverer further comprises a rotation housing formed to the cam portion, and
- wherein the outer plate is connected to the rotation housing.

4. The continuously variable valve lift apparatus of claim 2, wherein:
- a stopper protrudes from the inner plate; and
- a stopper slot is formed to the outer plate for limiting movement of the stopper.

5. The continuously variable valve lift apparatus of claim 1, further comprising a bearing disposed between the cam portion and the slider housing.

6. The continuously variable valve lift apparatus of claim 1, wherein the control portion comprises:
- an eccentric shaft rotatably connected to the slider housing; and
- a control motor configured to selectively rotate the eccentric shaft for changing a position of the slider housing.

7. The continuously variable valve lift apparatus of claim 6, wherein a pivot shaft hole into which the pivot shaft is inserted and an eccentric shaft hole into which the eccentric shaft is inserted are formed to the slider housing.

8. The continuously variable valve lift apparatus of claim 1, wherein the output portion comprises an output roller contacting the cam.

9. The continuously variable valve lift apparatus of claim 1, wherein the valve device comprises:
- a swing arm roller contacting the valve shoe; and
- a valve.

10. The continuously variable valve lift apparatus of claim 1, wherein:
- the rotation deliverer is formed to both sides of the slider housing;
- the cam is disposed between the slider housing and each rotation deliverer;
- the output portion comprises two output rollers contacting each cam and two valve shoes; and
- the valve device comprises two swing arm rollers contacting each valve shoe and valves.

11. The continuously variable valve lift apparatus of claim 10, wherein the rotation deliverer comprises:
- an inner plate connected to the camshaft and from which a control pin protrudes;
- a rotation housing formed on the cam portion; and
- an outer plate on which a control slot where the control pin movable therein is formed, and configured to transmit rotation of the inner plate to the cam portion.

12. The continuously variable valve lift apparatus of claim 11, wherein:
- a stopper protrudes from the inner plate; and
- a stopper slot is formed to the outer plate for limiting movement of the stopper.

13. An engine comprising:
- a camshaft;
- a cam portion including a cam, wherein the camshaft is inserted into the cam portion;
- a slider housing into which the cam portion is rotatably inserted and disposed to be rotatable around a pivot shaft mounted to a cylinder head;
- a control portion selectively rotating the slider housing around the pivot shaft;
- a rotation deliverer transmitting rotation of the camshaft to the cam portion;
- an output portion rotatable around the pivot shaft and on which a valve shoe is formed; and
- a valve device driven by the valve shoe.

14. The engine of claim 13, wherein the rotation deliverer comprises:
- an inner plate connected to the camshaft and from which a control pin protrudes;
- a rotation housing formed on the cam portion; and
- an outer plate on which a control slot where the control pin movable therein is formed, and configured to transmit rotation of the inner plate to the cam portion.

15. The engine of claim 14, wherein:
- a stopper protrudes from the inner plate; and
- a stopper slot is formed on the outer plate for limiting movement of the stopper.

16. The engine of claim 13, further comprising a bearing disposed between the cam portion and the slider housing.

17. The engine of claim 13, wherein the control portion comprises:

an eccentric shaft rotatably connected to the slider housing; and a control motor configured to selectively rotate the eccentric shaft for changing a position of the slider housing.

18. The engine of claim 13, wherein:

the rotation deliverer is formed to both sides of the slider housing;

the cam is disposed between the slider housing and each rotation deliverer;

the output portion comprises two output rollers contacting each cam and two valve shoes; and the valve device comprises two swing arm rollers contacting each valve shoe and valves.

19. The engine of claim 18, wherein the rotation deliverer comprises:

an inner plate connected to the camshaft and from which a control pin protrudes;

a rotation housing formed on the cam portion; and an outer plate on which a control slot where the control pin movable therein is formed, and configured to transmit rotation of the inner plate to the cam portion.

20. The engine of claim 19, wherein:

a stopper protrudes from the inner plate; and a stopper slot is formed on the outer plate for limiting movement of the stopper.

* * * * *